US005373835A

United States Patent [19]

Pourtau

[11] Patent Number: 5,373,835

[45] Date of Patent: Dec. 20, 1994

[54] JIG FOR CUTTING TILES DIAGONALLY

[75] Inventor: Thierry Pourtau, Croissy Sur Seine, France

[73] Assignee: Tomecanic, Aubergenville, France

[21] Appl. No.: 126,033

[22] Filed: Sep. 23, 1993

[30] Foreign Application Priority Data

Sep. 25, 1992 [FR] France ..... 92 11491

[51] Int. Cl.[5] ..... B28D 1/22

[52] U.S. Cl. ..... 125/23.01; 225/96.5

[58] Field of Search ..... 125/23.01, 23.02, 35; 225/96, 96.5; 83/37, 49, 51, 52, 300, 303, 307.2, 318, 578

[56] References Cited

U.S. PATENT DOCUMENTS

| | | | |
|---|---|---|---|
| 1,994,420 | 3/1935 | Persson | 125/23.02 |
| 2,568,816 | 9/1951 | Mars | 125/23.02 |
| 3,371,833 | 3/1968 | Sutton | 225/96.5 |
| 4,026,262 | 5/1977 | Yasuga | 225/96.5 |
| 4,192,282 | 3/1980 | Fischer | 125/23.02 |
| 4,770,156 | 9/1988 | Sucarrats | 125/23.02 |
| 4,774,930 | 10/1988 | Sellers | 225/96.5 |
| 5,040,445 | 8/1991 | Liou | 225/96.5 |
| 5,040,521 | 8/1991 | Pourtan et al. | 225/96.5 |
| 5,169,045 | 12/1992 | Liu | 225/96.5 |

FOREIGN PATENT DOCUMENTS

| | | | |
|---|---|---|---|
| 1175303 | 3/1959 | France . | |
| 2462244 | 2/1981 | France . | |
| 2855649 | 7/1980 | Germany | 125/23.02 |
| 2218375 | 11/1989 | United Kingdom | 125/23.02 |

*Primary Examiner*—Maurina T. Rachuba
*Attorney, Agent, or Firm*—Shenier & O'Connor

[57] ABSTRACT

The invention relates to a machine for cutting tiles and comprising: a stand provided with a bottom for supporting a tile; a cutting member; and a tile-breaking bar secured to the stand, projecting relative to the bottom thereof, and enabling a tile to be broken after it has been cut. According to the invention, the stand has a first notch suitable for receiving a first corner of a tile to be cut, and a slide which is mounted to slide along the tile-breaking bar and which includes a second notch suitable for receiving a second corner of said tile. An application lies in providing a machine enabling a cutting axis to be adapted accurately, simply, and cheaply relative to tiles having two opposite corners.

5 Claims, 4 Drawing Sheets

JIG FOR CUTTING TILES DIAGONALLY

Machines are known for cutting ceramic tiles of earthenware or analogous materials that make it possible to perform all kinds of cut required for making up complete tiling. Nevertheless, it very often happens that the geometrical shapes of surfaces to be tiled and of the tiles themselves are such that tilers go to considerable lengths to organize tiling in such a manner as to require simple cuts only.

BACKGROUND OF THE INVENTION

One such simple cut is to cut a square tile along its diagonal. At present, the tile to be cut is positioned beneath the cutting tool by inspection only, with successive approximations.

OBJECT AND SUMMARY OF THE INVENTION

The invention seeks to make this adjustment automatic and naturally accurate as well, so as to make it simple to perform.

The invention thus relates to a stand having a plane bottom designed for supporting a tile to be cut, the bottom having a cutting axis and two longitudinal ends and, in the proximity of a first one of said longitudinal ends, a first notch suitable for receiving a first corner of a tile to be cut, the notch being centered in the plane containing the cutting axis, and perpendicular to the bottom of the stand;

- a longitudinal slideway device parallel to the cutting axis;
- a first slide moveably mounted on said slideway device and supporting a tile-cutting tool; and
- a longitudinal tile-breaking bar secured to the stand and disposed parallel to the cutting axis, the bar having an edge projecting relative to the bottom of the stand and lying in the plane that is perpendicular to the bottom and that contains the cutting axis for the purpose of enabling a tile to be broken after it has been cut.

According to the invention, a second side is slidably mounted on the tile-breaking bar and has a second notch suitable for receiving a second corner of said tile to be cut, which notch is centered in the plane containing the cutting axis and perpendicular to the bottom of the stand, and has its orientation relative to said plane kept constant by said tile-breaking bar.

The following advantages dispositions are preferably also adopted:

- the second slide includes a guide groove disposed astride and guided by the tile-breaking bar and which is merely placed on said tile-breaking bar;
- each of said first and second notches is defined by two first plane faces perpendicular to the bottom of the stand and has a V-shaped right cross-section whose bisector plane perpendicular to the bottom of the stand contains the cutting axis;
- the branches of each V-shape are at an angle of 90° to each other; and
- each of the two first faces of each notch is extended in the proximity of the corner of the V-shape by a respective plane second face perpendicular to the bottom of the stand and parallel to the cutting axis, said second faces not intersecting the cutting axis.

The main advantage of the invention lies in the fact that it makes it possible by using a cheap addition for known machines to achieve accurate cuts in simple manner along the diagonals of square tiles (or more generally of tiles having pairs of edges), regardless of the initial dimensions of the tiles.

BRIEF DESCRIPTION OF THE DRAWINGS

The invention will be better understood and secondary characteristics and advantages will appear on reading the following description of an embodiment given by way of example.

Naturally, the description and the drawings are given purely by way of non-limiting indication.

Figure 1:
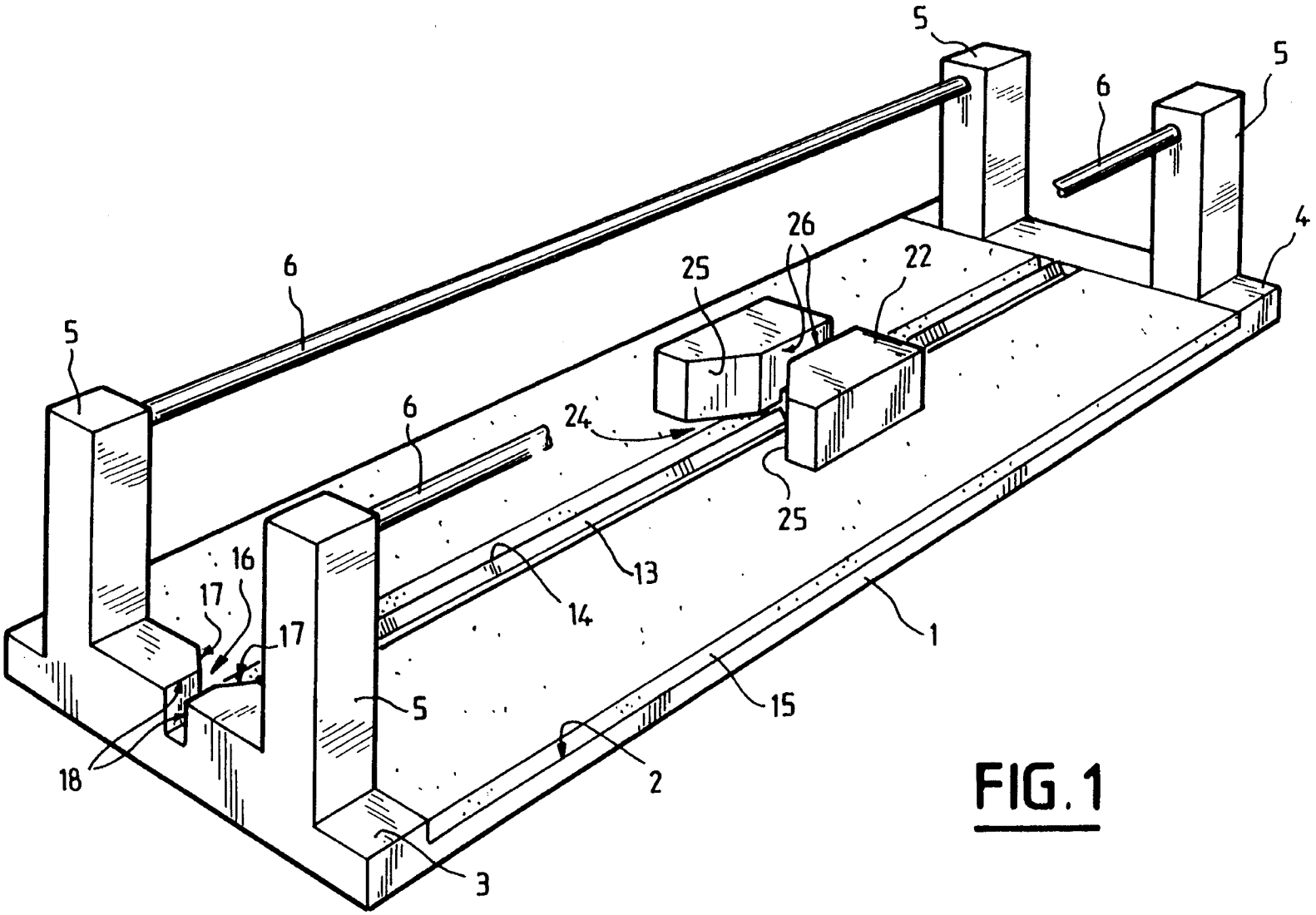
Figure 2:
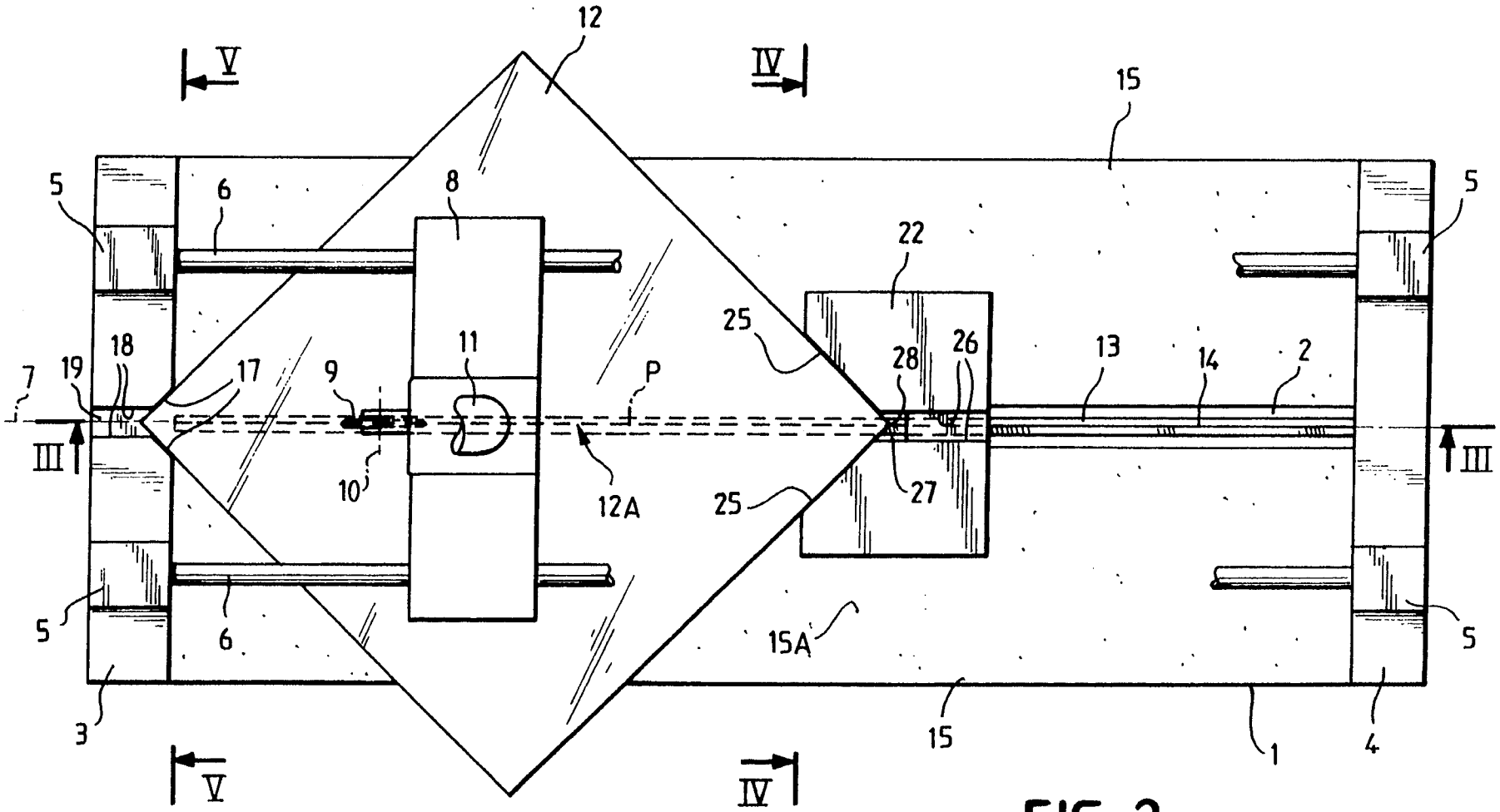
Figure 3:
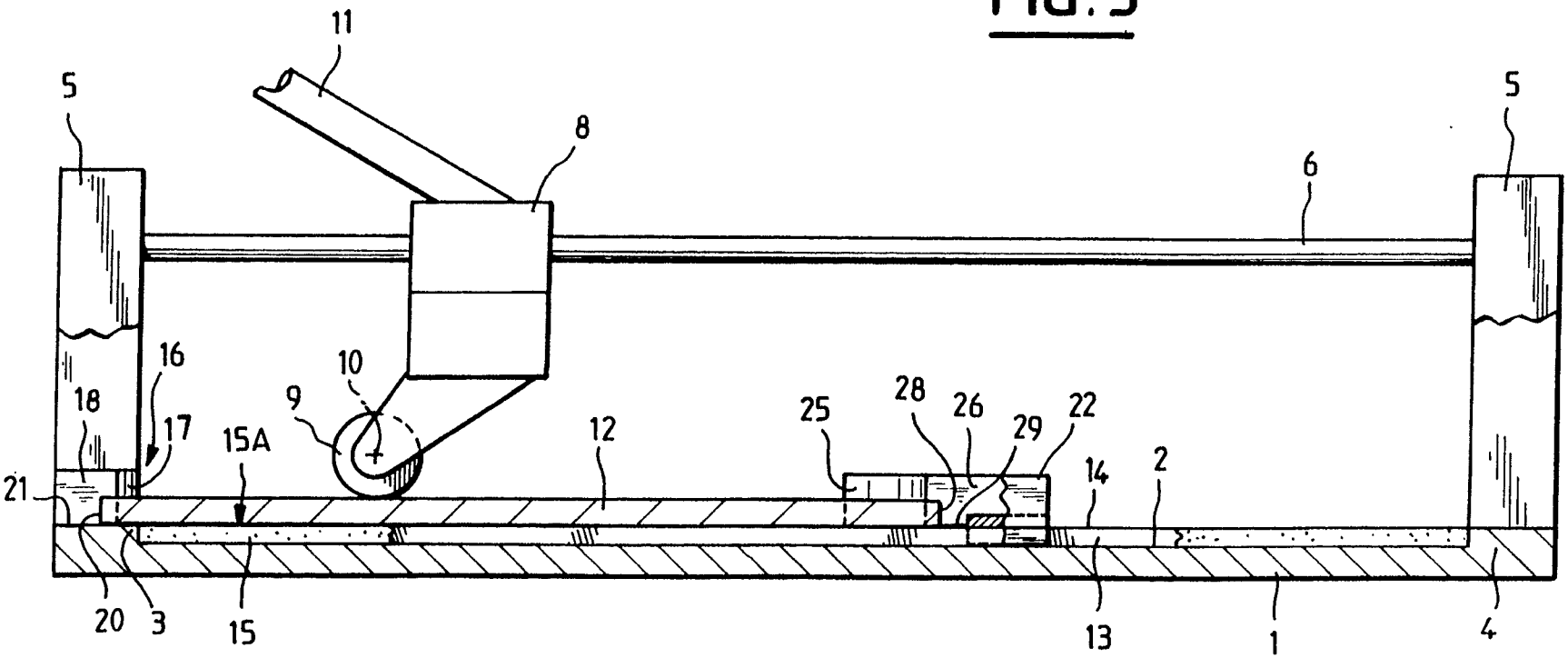

Reference is made to the accompanying drawings, in which:

FIG. 1 is a perspective view of a portion of a machine of the invention;

FIG. 2 is a plan view of the FIG. 1 machine;

FIG. 3 is a section on III—III of FIG. 2; and

Figure 5:
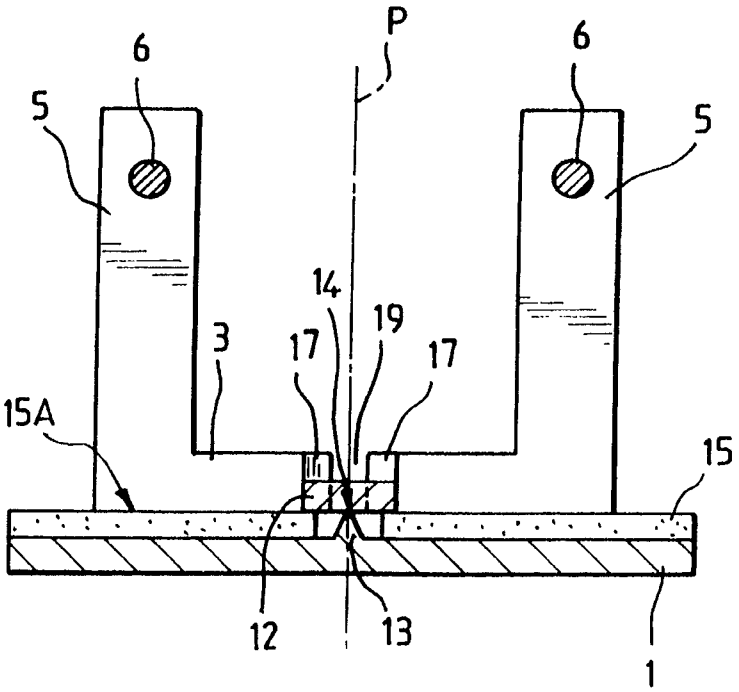
Figure 4:
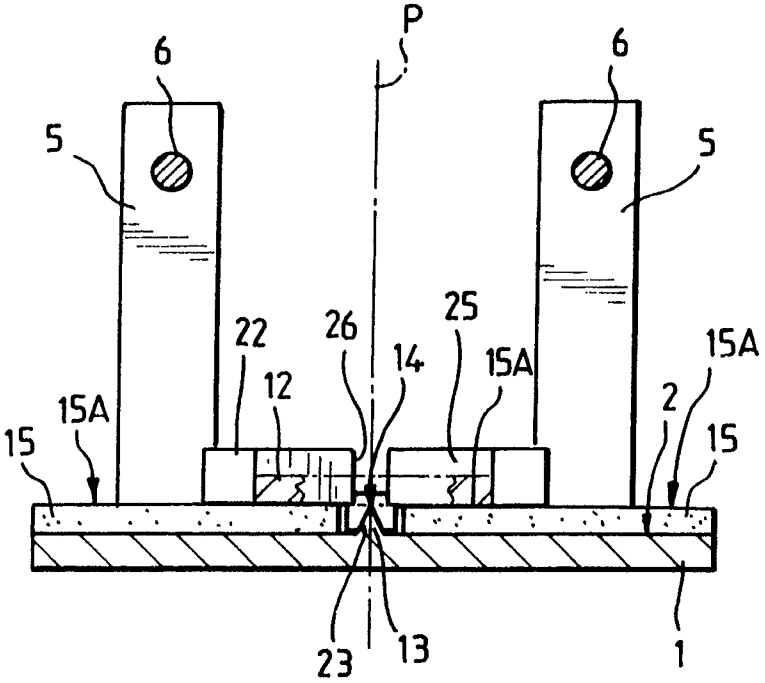

FIGS. 4 and 5 are sections on IV—IV and on V—V respectively of FIG. 2.

MORE DETAILED DESCRIPTION

The machine for cutting ceramic tiles of earthenware or of analogous materials and as shown in the figures comprises:

- a stand 1 having a plane bottom 2, a first end 3, and a second end 4, with columns 5 standing perpendicularly on the bottom 2, there being two columns at each end, the columns supporting mutually parallel rods 6 that are also parallel to the cutting axis 7 of the bottom 2, thereby constituting slideways;
- a first slide 8 is mounted on the rods 6 to slide parallel to the axis 7, and it supports a cutting member 9 which is constituted in the present case by a cutting wheel rotatably mounted on the first slide 8 about an axis 10 that is parallel to the bottom 2 and perpendicular to the cutting axis 7, the plane of the wheel containing said cutting axis 7, while a control lever 11 serves in conventional manner both to displace the first slide 8 along the rods 6 and to control the force with which the cutting member 9 is pressed against the square tile 12 to be cut;
- a section bar 13 secured to the bottom 2 and projecting from said bottom, having an edge 14 lying in the longitudinal plane P that contains the cutting axis 7 and that is perpendicular to the bottom 2; the section bar 13 and its edge 14 enabling said tile 12 to be broken along a score line that has been cut by the cutting member 9; and
- constant-thickness slabs 15 of elastomer lying on the bottom 2 and disposed on either side of the tile-breaking bar 13.

The first end 3 of the stand also includes a first notch 16 defined by two plane first faces 17 perpendicular to the bottom 2 having a V-shaped right cross-section. In the embodiment shown, the V-shape is symmetrical about the plane P and it opens out at 90° (in other words, its bisector plane coincides with the plane P). Second faces 18 that are also plane, perpendicular to the bottom 2, and parallel to the plane P extend said first faces 17 without passing through the plane containing the cutting axis, thereby forming a recess 19 for receiving a first corner 20 of a tile 12. The bottom 21 of the first notch 16 is at the same level as or is slightly below the top faces 15A of the elastomer slabs 15.

Similarly, a second slide 22 has a bottom groove 23 that is complementary in shape to the tile-breaking bar 13, thereby enabling it to be fitted astride the tile-breaking bar so as to receive its edge 14, thus enabling its orientation to be kept constant relative to the plane P, the slide 22 also includes a second notch 24 defined by two plane first faces 25 perpendicular to the bottom 2 and having a V-shaped right cross-section. In the embodiment shown, the V-shape of the cross-section of the second slide 22 is opened at 90° and, given that the orientation of the second slide 22 is maintained relative to the plane P, the V-shape of its cross-section is permanently symmetrical about the plane P. Plane second faces 26 perpendicular to the bottom 2 and parallel to the plane p extend said first faces 25 and, since they do not pass through the plane containing the cutting axis they form a recess 27 for receiving a second corner 28 of the tile 12. The bottom 29 of the second notch 24 is at the same level as or slightly beneath the top faces 15A of the elastomer slabs 15. The second slide 22 is placed between the first and second ends 3 and 4 of the stand 1.

In the embodiments shown, the second slide 22 is separate from the remainder of the machine, being removable therefrom, and it is merely put into place on the tile-breaking bar 13. In a variant, it will be possible to design the shape of the groove 23 and of the bar 13 so as to ensure that the second slide 22 remains permanently on the machine without being easily removable therefrom.

It is also possible, in a variant, to provide for the V-shapes of the first and second notches 16 and 24 to open at an angle other than 90°. The notches 16 and 24 are designed to provide simple and accurate centering of a diagonal 12A of a tile 12 by placing the diagonal in the cutting plane P, with this being achieved merely by inserting the corners 20 and 28 in said notches.

When the tile 12 is square in shape, as shown, then the angle of the V-shapes must be equal to 90°. It can then be seen that by placing two opposite corners of a tile 12 in the notches 16 and 24 and by pressing the sides of said tile that define said angles against the plane first faces 17 and 25 of the notches 16 and 24, it is very simple to place the diagonal of the tile 12 passing through said angles accurately in said plane P, thereby subsequently ensuring that the tile is cut accurately along said diagonal.

It is also easy to understand that if the tile 12 has a different shape, then the angle of the V-shape should be correspondingly different. Thus, to cut a hexagonal tile along a diagonal between two diametrically opposite corners, the angles of the V-shapes must be equal to 120° so as to enable the sides of the tile defining said corners to be accurately received.

It should be observed that having the second slide 22 freely slidable along the tile-breaking bar 13 makes it possible to adapt the machine instantly to cutting tiles that are of the same shape but of different dimensions.

The invention is not limited by the embodiment described, but on the contrary it extends to all variants that may be applied thereto without going beyond the ambit or the spirit of the invention.

I claim:

1. A machine for cutting tiles, in particular ceramic tiles, the machine comprising:

a stand having a plane bottom designed for supporting a tile to be cut, the bottom having a cutting axis and two longitudinal ends and, in the proximity of a first one of said longitudinal ends, a first notch suitable for receiving a first corner of a tile to be cut, the notch being centered in the plane containing the cutting axis, and perpendicular to the bottom of the stand;

a longitudinal slideway device parallel to the cutting axis;

a first slide moveably mounted on said slideway device and supporting a tile-cutting tool; and a longitudinal tile-breaking bar secured to the stand and disposed parallel to the cutting axis, the bar having an edge projecting relative to the bottom of the stand and lying in the plane that is perpendicular to the bottom and that contains the cutting axis for the purpose of enabling a tile to be broken after it has been cut;

wherein a second slide is slidably mounted on the tile-breaking bar and has a second notch suitable for receiving a second corner of said tile to be cut, which notch is centered in the plane containing the cutting axis and perpendicular to the bottom of the stand, and has its orientation relative to said plane kept constant by said tile-breaking bar.

2. A machine according to claim 1, wherein the second slide includes a guide groove disposed astride and guided by the tile-breaking bar and which is merely placed on said tile-breaking bar.

3. A machine according to claim 1, wherein each of said first and second notches is defined by two first plane faces perpendicular to the bottom of the stand and has a V-shaped right cross-section whose bisector plane perpendicular to the bottom of the stand contains the cutting axis.

4. A machine according to claim 3, wherein the branches of each V-shape are at an angle of 90° to each other.

5. A machine according to claim 3, wherein each of the two first faces of each notch is extended in the proximity of the corner of the V-shape by a respective plane second face perpendicular to the bottom of the stand and parallel to the cutting axis, said second faces not intersecting the cutting axis.

* * * * *